United States Patent [19]

Woloszczuk

[11] Patent Number: 4,983,986

[45] Date of Patent: Jan. 8, 1991

[54] SLOT ANTENNA

[75] Inventor: Edmund W. Woloszczuk, Essex, United Kingdom

[73] Assignee: The General Electric Company, p.l.c., London, United Kingdom

[21] Appl. No.: 286,845

[22] Filed: Dec. 20, 1988

[51] Int. Cl.[5] ..... H01Q 13/100; H01Q 1/420

[52] U.S. Cl. ..... 343/771; 343/789

[58] Field of Search ..... 343/700 MS, 767, 769, 343/846, 771, 789

[56] References Cited

U.S. PATENT DOCUMENTS

| | | | |
|---|---|---|---|
| 2,885,676 | 5/1959 | Baldwin | 343/769 |
| 3,806,945 | 3/1974 | Proctor | 343/767 |
| 4,130,822 | 12/1978 | Conroy | 343/700 MS |
| 4,197,545 | 4/1980 | Favaloro et al. | 343/700 MS |
| 4,353,072 | 10/1982 | Monser | 343/725 |
| 4,367,475 | 1/1983 | Schiavone | 343/767 |
| 4,409,595 | 10/1983 | Park | 343/771 |
| 4,426,649 | 1/1984 | Dubost et al. | 343/700 MS |
| 4,486,758 | 12/1984 | deRonde | 343/700 MS |
| 4,528,568 | 7/1985 | Woloszczuk | 343/770 |

FOREIGN PATENT DOCUMENTS

| | | | |
|---|---|---|---|
| 0085486 | 1/1983 | European Pat. Off. | 343/803 |
| 1285289 | 8/1972 | United Kingdom . | |
| 2191045 | 12/1987 | United Kingdom | 343/792 |

OTHER PUBLICATIONS

E. N. Clouston et al. "A Triplate Stripline Slot Antenna Developed for Time-Domain Measurements on Phased Arrays" International Symposium Digest, vol. 1, pp. 312–315, Jun. 1988.

*Primary Examiner*—Rolf Hille
*Assistant Examiner*—Peter Toby Brown
*Attorney, Agent, or Firm*—Spencer & Frank

[57] ABSTRACT

A triplate fed slot antenna in which a conductive sheet has a slot with a length of λ, where λ is the wavelength of a signal intended to be radiated from or received by the antenna. A triplate feed structure is coupled for feeding the slot. The triplate feed structure includes two outer conductors defining walls of a resonant cavity backing the slot, and an inner conductor disposed in the cavity.

7 Claims, 2 Drawing Sheets

SLOT ANTENNA

FIELD OF THE INVENTION

This invention relates to slot antennas.

DESCRIPTION OF THE PRIOR ART

It is well known to use slots in conductive sheets as radiating or receiving elements in antennas. Such antennas generally have signals fed to or picked up from them by co-axial lines. This is unsatisfactory because the attachment of the co-axial cables must be carried out with great precision and the expense of this operation is a significant fraction of the cost of the antenna.

BRIEF SUMMARY OF THE INVENTION

This invention provides a triplate fed slot antenna.

Such an antenna is cheap and simple to construct and physically rugged.

Preferably the slot is λ in length, where λ is an intended transmission or reception frequency of the antenna, because this gives an impedence of about 50 Ω for the slot, which is the same as a triplate feed structure and so gives good impedence matching between the antenna element and its triplate feed structure.

Some antennas employing the invention will now be described, by way of example only, with reference to the accompanying Figures in which:

DETAILED DESCRIPTION

Figure 1A:
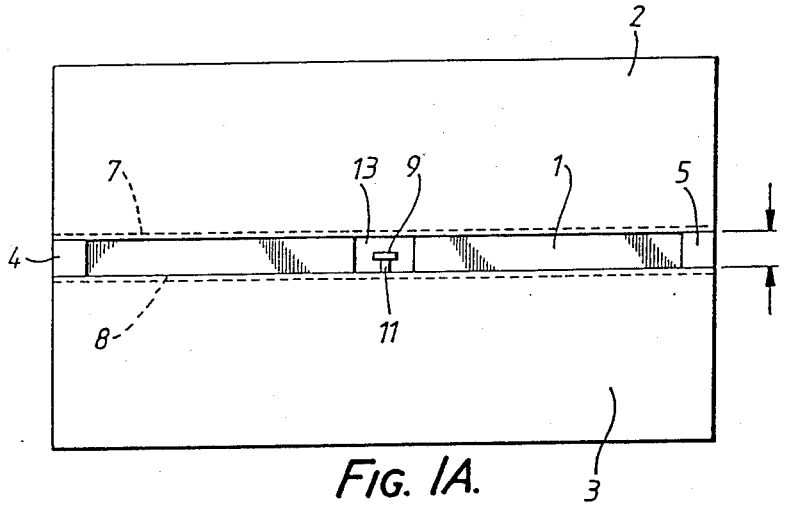
FIG. 1A shows a plan view of an "end fire" antenna employing the invention.
Figure 1B:
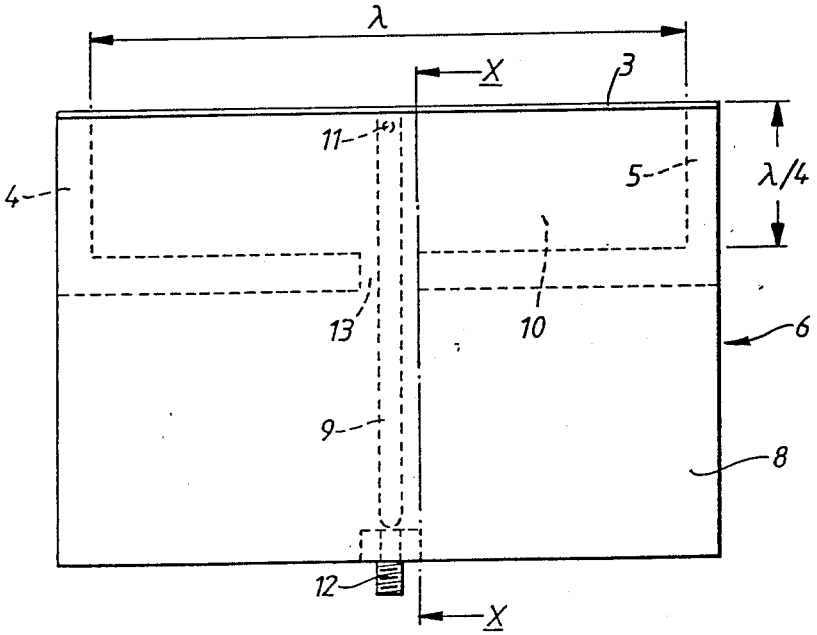
FIG. 1B shows a side view of the antenna of FIG. 1A.
Figure 1C:
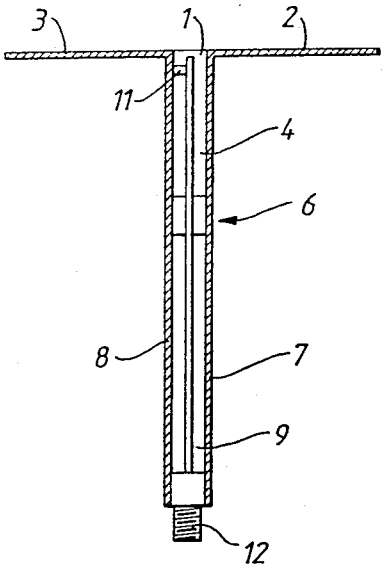
FIG. 1C shows a cross section along the line x—x of FIG. 1B.

Referring to FIGS. 1A to 1C, a triplate fed slot radiator having a sensitivity pattern parallel to its triplate feed is shown. A slot 1 is defined by two ground planes 2 and 3 and a pair of conductive elements 4 and 5, each of the conductive elements 4 and 5 being electrically connected to both of the ground planes 2 and 3. The slot is λ in length, where λ is the intended frequency of radiation or reception.

The slot 1 is fed by a triplate feed structure 6 comprising two outer conductors 7 and 8 and an inner conductor 9.

Behind the slot 1 is a cavity 10 defined by the two conductive elements 4 and 5 and the triplate outer conductors 7 and 8. The cavity 10 is approximately λ/4 in depth and thus is a resonant cavity. The slot 1 and the triplate feed 6 should both, in theory, have an impedence of 50 Ω and be perfectly matched. In practice however, this is unlikely to be the case and the exact depth of the cavity 10 can be varied to alter the impedence of the slot 1 to match the impedence of the triplate feed 6. A conductive peg 11 connects the triplate inner conductor 9 to the triplate outer conductor 8 adjacent to the slot 1. This allows the slot 1 to be fed from the triplate 6. A gap 13 between the conductive elements 4 and 5 allows the triplate inner conductor 9 to pass into the cavity 10, the inner conductor 9 passing through the center of the gap 13. The gap 13 is made larger than the separation of the triplate outer conductors 7 and 8 so that the passage of the central conductor 9 through the gap 13 does not affect the triplate feed 6.

Signals are supplied to or picked up from the triplate 6 via a socket 12.

When signals are applied to the slot 1 they excite the slot 1 and it radiates a unidirectional radiation pattern. Similarly when acting as a receiver the slot will have a unidirectional sensitivity pattern.

Figure 2B:
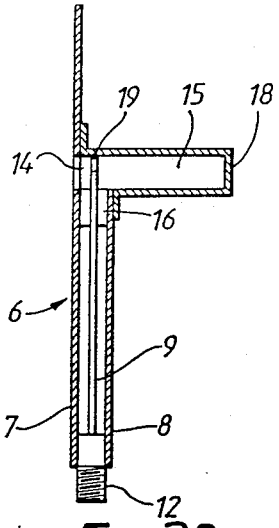
FIG. 2B shows a cross section along the line y—y of FIG. 2A, identical parts having the same reference numerals throughout.
Figure 2A:
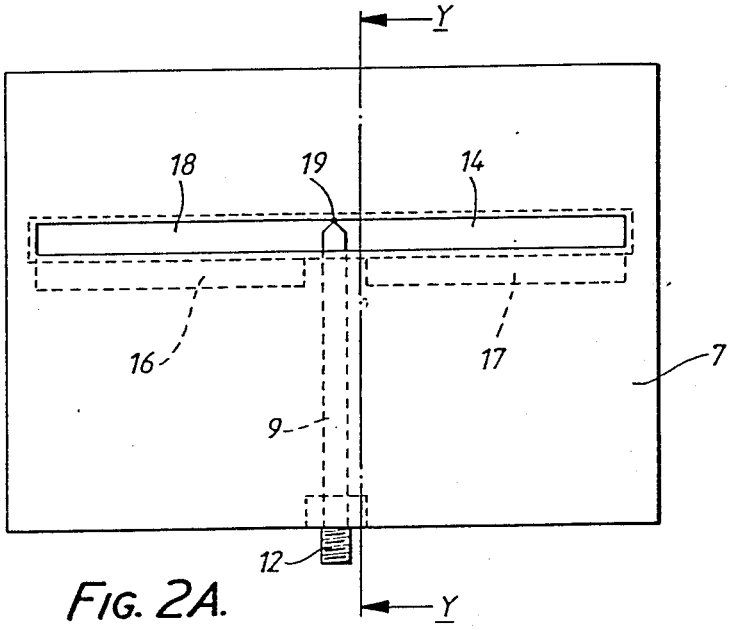
FIG. 2A shows a side view of a "broadside" antenna employing the invention.

Referring now to FIGS. 2A and 2B, a triplate fed slot radiator having a sensitivity pattern perpendicular to its triplate feed is shown.

A triplate feed 6 comprises two outer conductors 7 and 8 and an inner conductor 9 and is supplied with signals via a socket 12 as before.

A slot 14, λ in length, is cut from the outer conductor 7. Behind the slot 14 is a resonant cavity 15 approximately λ/4 in depth and defined by a pair of conductive elements 16 and 17 and a conductive member 18. Like the cavity shown in FIG. 1 the precise depth of the cavity 15 can be altered to vary the impedence of the slot 14.

The inner conductor 9 of the triplate 6 is electrically linked to the conductive member 18 at a point 19 adjacent to, and half way along, one side of the slot 14.

What is claimed:

1. A three conductor fed slot antenna, comprising:
   two ground planes defining a slot therebetween;
   two conductive elements electrically connected to the ground planes and spaced apart between said ground planes to define a length of λ of said slot, where λ is the wavelength of a signal intended to be radiated from or received by said antenna, said two conductive elements defining end walls of a resonant cavity backing the slot; and
   a three conductor feed structure coupled for feeding the slot and including two outer conductors each connected to a respective one of the ground planes and an inner conductor centrally disposed in the cavity.

2. An antenna as defined in claim 1, wherein the cavity has a depth of substantially λ/4.

3. An antenna as defined in claim 1, wherein said two conductive elements have first portions defining the end walls of the cavity and second portions defining the depth of the cavity.

4. An antenna as defined in claim 3, wherein said second portions define a gap through which said inner conductor extends into the cavity.

5. An antenna as defined in claim 4, wherein the gap between said second portions is larger than the separation between said outer conductors.

6. An antenna as defined in claim 1, and further including a conductive peg disposed in the cavity and connecting said inner conductor to one of said outer conductors.

7. An antenna as defined in claim 1, wherein said two outer conductors define side walls of the resonant cavity backing the slot.

* * * * *